United States Patent [19]

Haston et al.

[11] Patent Number: 4,526,367

[45] Date of Patent: Jul. 2, 1985

[54] PORTABLE BASKETBALL GOAL

[76] Inventors: James E. Haston, 119 Johnston Pkwy., Raymore, Mo. 64083; Anthony D. Orloff, 1023 Monroe, Kansas City, Mo. 64127

[21] Appl. No.: 542,895

[22] Filed: Oct. 17, 1983

[51] Int. Cl.[3] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| D. 202,716 | 11/1965 | Procter | 273/1.5 R UX |
| D. 255,040 | 5/1980 | Cochran et al. . | |
| 1,504,166 | 8/1924 | Thornley . | |
| 1,924,811 | 8/1933 | Schulz . | |
| 2,227,310 | 12/1940 | Hoppes et al. . | |
| 2,881,003 | 4/1959 | Drew | 273/1.5 R |
| 3,025,058 | 3/1962 | Brumfield . | |
| 3,427,025 | 2/1969 | Procter . | |
| 3,722,886 | 3/1973 | Sinner . | |
| 3,881,724 | 5/1975 | Beveridge | 273/1.5 R |
| 4,395,040 | 7/1983 | White | 273/1.5 R |
| 4,412,679 | 11/1983 | Mahoney et al. | 273/1.5 R |

FOREIGN PATENT DOCUMENTS

| | | | |
|---|---|---|---|
| 681631 | 10/1966 | Belgium | 273/1.5 R |
| 1341549 | 9/1963 | France | 273/1.5 R |
| 286216 | 2/1965 | Netherlands | 273/1.5 R |

OTHER PUBLICATIONS

Toss Back Circular pp. 1-4, 3-1977, The Aux-Z.

*Primary Examiner*—Paul E. Shapiro

*Attorney, Agent, or Firm*—Schmidt, Johnson, Hovey & Williams

[57] ABSTRACT

A portable basketball assembly is provided which can be readily collapsed into a lowered position permitting storage of the assembly in a conventional garage; in addition, the assembly can be wheeled to a desired location and elevated through a single winch cable to a regulation playing height. In preferred forms, the assembly includes a vertically shiftable, telescopic, backboard-supporting frame as well as structure for raising and lowering of the backboard relative to the frame. In this fashion, the overall assembly can assume a very low profile for storage purposes, whereas raising the backboard for playing is readily accomplished. The assembly can also be elevated to an intermediate playing position below regulation height to accommodate younger players, and an elongated brace secured to the backboard and engageable with the assembly base or frame is provided in order to stabilize the unit at all positions of the backboard.

7 Claims, 6 Drawing Figures

Fig.1.
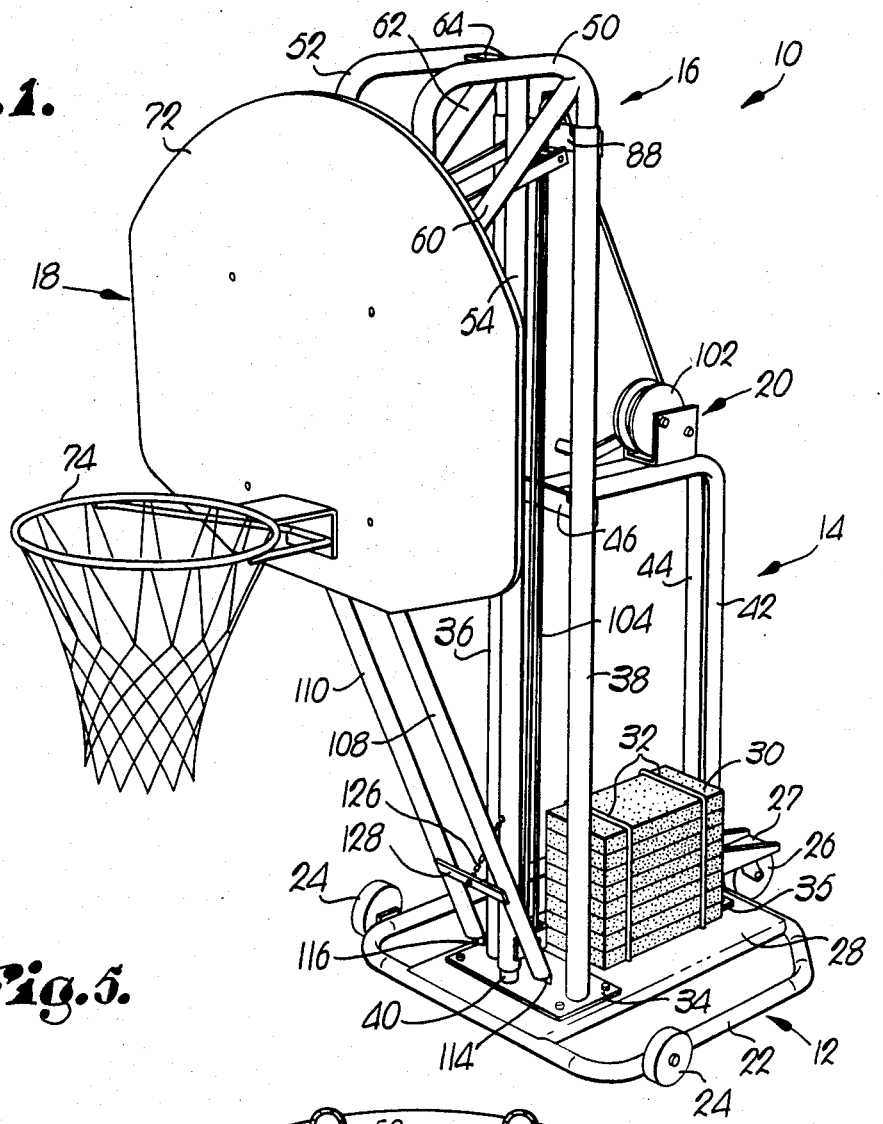
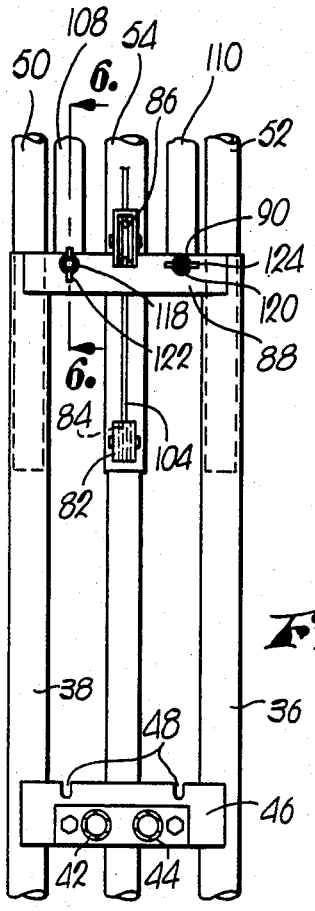
Fig.5.
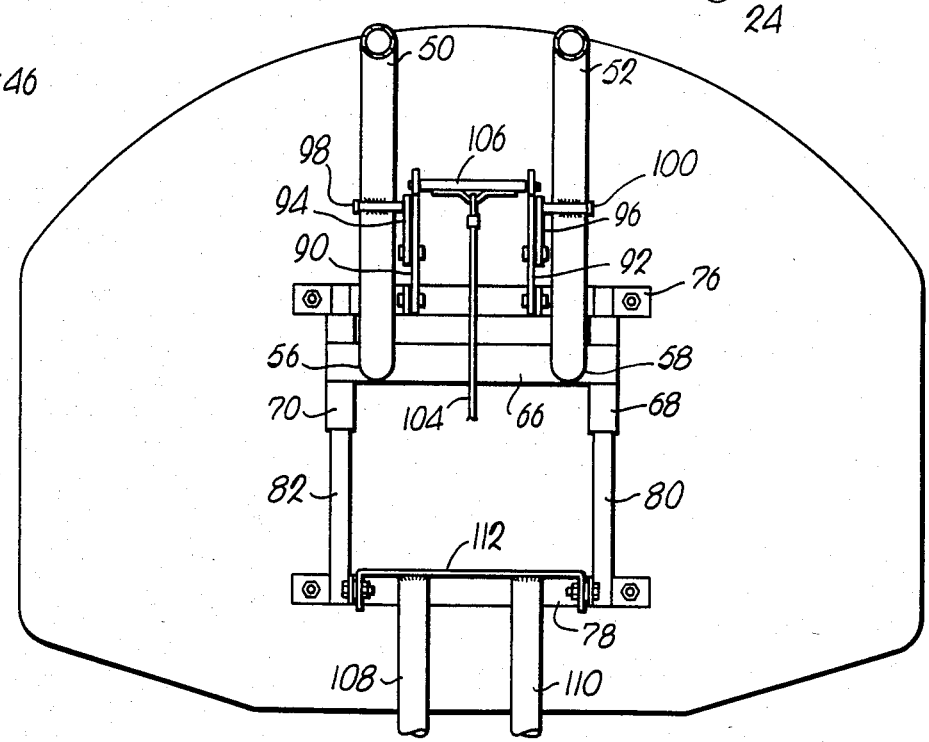
Fig.4.

PORTABLE BASKETBALL GOAL

BACKGROUND OF THE INVENTION

1. Field of the Invention

The present invention is broadly concerned with an improved, portable, collapsible basketball goal assembly which can be elevated to a regulation playing height and alternately lowered to a storage position. More particularly, it is concerned with such a basketball goal assembly which is especially constructed to achieve a very low storage profile permitting the assembly to be stored in a conventional garage.

2. Description of the Prior Art

Many youngsters and young adults enjoy playing basketball at their homes, using for this purpose a mounted backboard and goal of the well-known variety. In this regard, the conventional approach has been to mount a backboard and goal on a garage roof or on a permanent supporting pole, typically at a regulation height wherein the goal hoop is ten feet from the playing surface.

The foregoing approach has a number of problems however. First, some communities now have ordinances to the effect that basketball backboards and goals cannot be permanently mounted on garage roofs or adjacent driveways, inasmuch as it is felt that such equipment is unslightly and detracts from the overall appearance of the community. In addition, while a backboard and goal situated at the regulation height are desirable for teenagers and adults, such a height setting can present difficult playing conditions for youngsters because of their inability to effectively shoot a basketball to the required height. In response to this, it has been known to position a backboard and goal assembly at a lowered position, but here again permanent or relatively permanent backboard installation at a lower than regulation height can be expensive and is inherently only a transitory proposition.

In response to the foregoing problems, it has been known to provide portable basketball goal assemblies. These units are typically provided with a mobile base and upstanding frame structure, and in many cases the frame structure provides a degree of collapsibility so that the goal assembly can be lowered to a storage position when not in use. Typical prior basketball goal assemblies of this type are disclosed in U.S. Pat. Nos. 1,504,166, 1,924,811, 3,025,058, 3,427,025, 3,722,886 and Des. No. 255,040.

While portable and collapsible basketball goal assemblies have been proposed in the past, a number of practical problems remain. Perhaps the most significant problem in this regard is that prior assemblies are generally incapable of being collapsed to an overall height permitting the assembly to be wheeled into a conventional automotive garage. That is to say, in the usual garage the vertical door opening is no more than about 82 inches in height; and with prior collapsible goal assemblies, the overall height thereof in their storage position is greater than 82 inches.

In addition to the foregoing, many prior collapsible assemblies have not provided an intermediate playing position between the lowered, storage position and the uppermost, regulation playing position. Thus, these prior assemblies cannot accommodate the youthful player.

SUMMARY OF THE INVENTION

The problems outlined above are in large measure solved by the present invention which provides a greatly improved portable basketball assembly which is especially constructed for achieving a very low storage profile, while at the same time allowing the backboard and goal to be elevated to an intermediate and a regulation playing height.

The basketball goal assembly of the invention advantageously includes a mobile base, upstanding frame means, a backboard, a goal mounted on the backboard, and means securing the backboard to the frame means. Structure is also provided for operably coupling the frame means to the base for shifting of the frame means and backboard between a lower storage position and an upper playing position. In accordance with the invention, the means securing the backboard to the frame comprises structure mounting the backboard on the frame for up and down shifting movement of the backboard relative to the frame.

In particularly preferred forms, the backboard mounting structure includes telescopically interfitted, relatively axially shiftable members secured to the frame and backboard respectively, in order to assure smooth vertical shifting of the backboard relative to the frame.

In order to assist in elevating the backboard to a playing position, lifting means is provided which comprises pulley means operatively secured to the frame, along with a cable trained around the pulley means and operatively connected to the backboard, advantageously through the use of an elongated, pivotal connecting arm; the cable is secured to a manual winch, and the overall lift assembly is constructed and arranged for raising and lowering of the frame means relative to the base, and also for raising and lowering of the backboard relative to the frame.

BRIEF DESCRIPTION OF THE DRAWINGS

FIG. 1 is a perspective view of the basketball goal assembly of the invention, shown in its collapsed, storage position;

FIG. 4 is a fragmentary sectional view illustrating the rearward face of the backboard and the improved mounting structure between the shiftable frame and the backboard;

FIG. 5 is a fragmentary vertical sectional view illustrating portions of the frame structure of the overall basketball goal assembly.

DESCRIPTION OF THE PREFERRED EMBODIMENT

Figure 2:
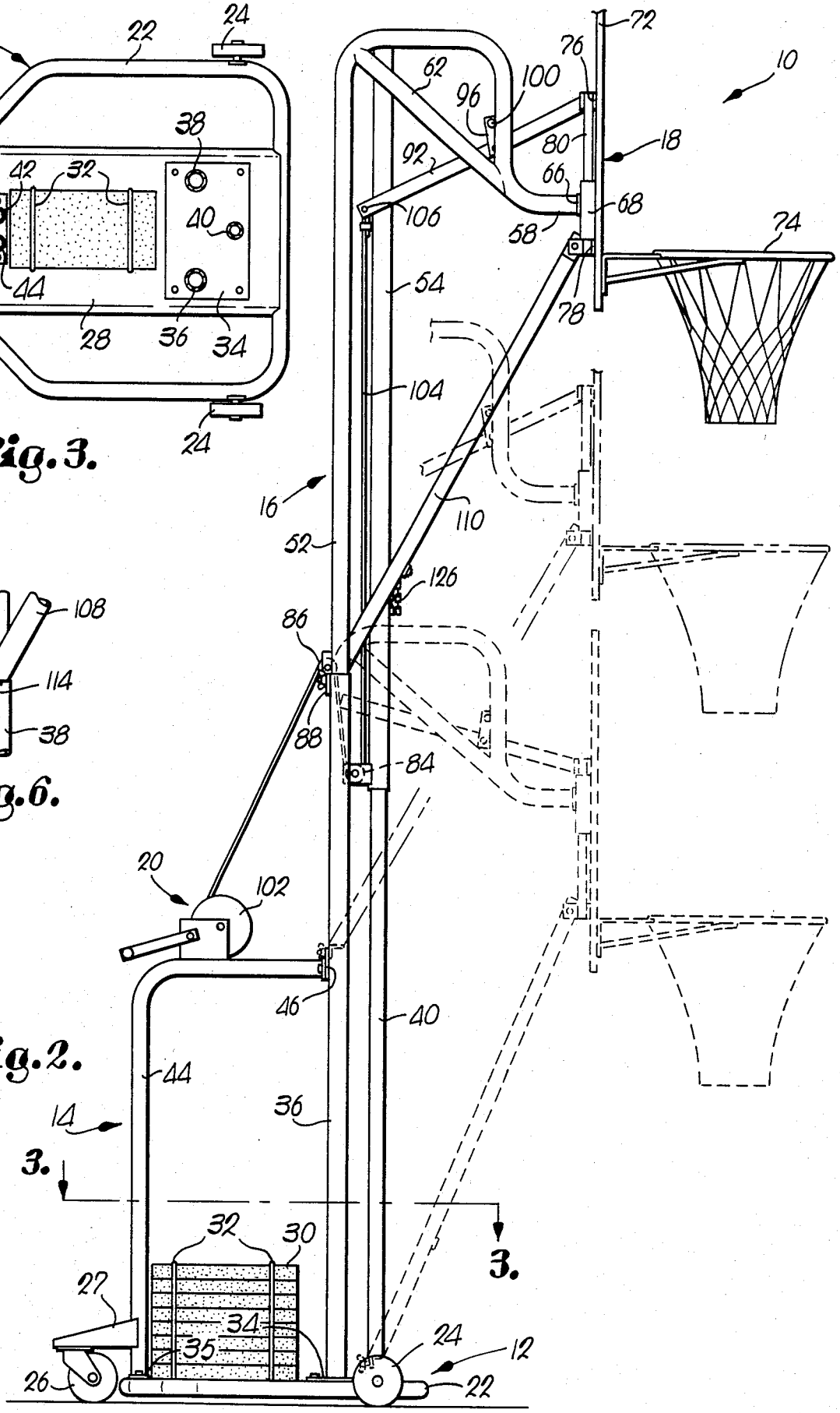
FIG. 2 is a side elevational view of the assembly depicted in FIG. 1, with the backboard and goal being illustrated in their regulation height positions in bold lines, and with the backboard and goal being shown in phantom in intermediate playing and storage positions, respectively.

Turning now to the drawings, a basketball goal assembly 10 is illustrated in FIGS. 1 and 2. Broadly speaking, the assembly 10 includes a base 12, upstanding frame structure 14 secured to the base 12 and including a shiftable subframe 16, a backboard and goal assembly 18, and operating mechanism broadly referred by the numeral 20.

Figure 3:
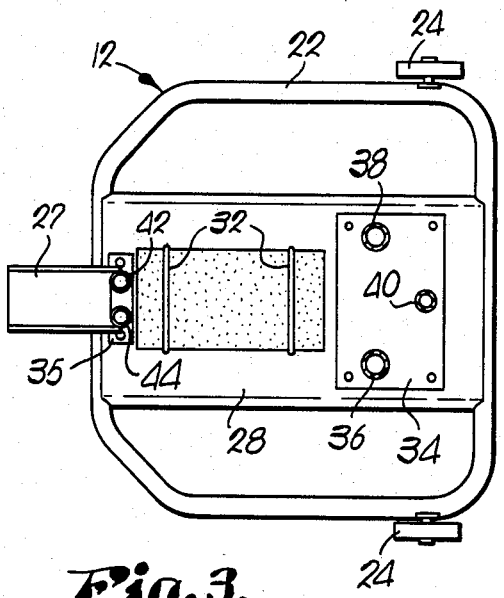
FIG. 3 is a sectional view taken along line 3—3 of FIG. 2.
Figure 6:
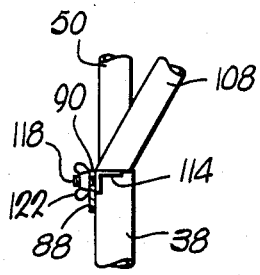
FIG. 6 is a vertical sectional view taken along line 6—6 of FIG. 5.

In more detail, the base 12 includes metallic, circumscribing, tubular, hexagonal frame 22 provided with a pair of juxtaposed forward wheels 24 as well as a caster wheel 26, the latter being secured to rigid mounting leg 27. In addition, a supporting plate 28 extends fore and aft of the frame 22 and is secured to the opposed ends thereof as best seen in FIG. 3. In use, a plurality of patio blocks 30, secured in place by means of straps 32, are positioned on plate 28 in order to provide counterweight for the overall assembly. In addition, a primary frame plate 34, and a smaller secondary frame plate 35, are secured to supporting plate 28 where illustrated (see FIG. 3).

The frame structure 14 includes a pair of juxtaposed, laterally spaced apart, upright rigid tubular members 36, 38, as well as a central, forward, rigid tubular member 40; it will be noted in this regard that the members 36–40 are rigidly secured to the plate 34, and that the members 36, 38 are of larger diameter than the central member 40. A pair of metallic, tubular bracing members 42, 44 of inverted L-shaped configuration also form a part of the frame structure 14. As illustrated, the members 42, 44 are secured to the secondary frame plate 35, extend upwardly and forwardly towards the upright tubular members 36, 38. The forwardmost ends of the bracing members 42, 44, are secured to a cross brace 46 (see FIG. 5), the latter being in turn secured to the members 36, 38. It will also be noted that upper margin of cross brace 46 is provided with a pair of notches 48; the purpose of these notches will be explained hereinafter.

Shiftable subframe 16 includes three elongated, metallic tubular members 50, 52 and 54 arranged for telescopic interfitting with the rigid tubular members 36–40. To this end, it will be seen that the members 50, 52 are laterally spaced apart and are of a diameter to telescope within corresponding upright tubular members 38 and 36 (see FIG. 5). In like manner, the forwardmost tubular member 54 is of a larger diameter so as to telescopically fit over the rigid tubular member 40 forming a part of frame structure 14.

Each of the juxtaposed tubular members 50, 52 includes a somewhat U-shaped upper end terminating in a forwardly extending terminus 56, 58. In addition, an oblique bracing element 60, 62 extends upwardly and rearwardly from the corresponding termini 56, 58 for connection to the U-shaped portions of the corresponding tubular members. Also, as best seen in FIG. 1, the uppermost end of forward tubular member 54 is affixed to a cross piece 64, the latter being in turn secured to the U-shaped portions of the respective tubular members 50, 52.

The forwardmost end of the termini 56, 58 are affixed to a metallic cross member 66, and the latter in turn supports a pair of laterally spaced apart, upright tubular elements 68, 70.

The assembly 18 includes a regulation backboard 72 as well as a conventional goal hoop 74 secured to the forward face of the backboard. In addition, the rearward face of the backboard is provided with a mounting frame including a pair of vertically spaced apart, laterally extending metallic cross pieces 76, 78 which support a pair of vertical, laterally spaced apart tubular components 80, 82. The components 80, 82 are spaced slightly from the rearward surface of the backboard 72 (see FIG. 2) and telescopically receive the corresponding tubular elements 68, 70. Thus, the backboard 72 is vertically shiftable relative to the shiftable subframe 16, with the limits of vertical movement being defined by the cross pieces 76, 78.

Operating mechanism 20 includes a first pulley 84 affixed to the lower end of forward tubular member 54, and a second fixed pulley 86 positioned adjacent the top of the rigid tubular members 36, 38. A metallic cross plate 88 is provided which extends between and is connected to the tubular members 36, 38. The pulley 86 is secured to the plate 88 (see FIG. 5), and the latter is provided with notches 90 in the manner of cross brace 46 previously described.

The overall operating mechanism 20 further includes a pair of elongated, laterally spaced apart, parallel linkage arms 90, 92 which are pivotally coupled to upper cross piece 76 secured to backboard 72 (see FIG. 4). The linkage arms 90, 92 extend rearwardly from backboard 72 and lie between the upstanding tubular members 50, 52. A pair of short links 94, 96 are pivotally secured to the corresponding arms 90, 92 intermediate the length of the latter, are in turn pivotally mounted on pins 98, 100 respectively secured to the members 50, 52.

A manually operable winch 102 is secured to the bracing members 42, 44, and has an operating cable 104 extending therefrom. The cable 104 is trained around pulley 86 and thence around pulley 84, whereupon it extends upwardly and is connected to the linkage arms 90, 92 through the medium of cross pin 106.

In order to further stabilize the overall assembly 10, a pair of elongated bracing legs 108, 110 are provided. The legs 108, 110 are pivotally secured to lowermost cross piece 78 (see FIG. 4) by means of a metallic angle 112, and extend downwardly and rearwardly from backboard 72 for engagement with either base 12 or frame structure 14. The lowermost ends of the legs 108, 110, are provided with respective angle segments 114, 116, which in turn support threaded studs 118, 120. Wing nuts 122, 124 are threaded onto the corresponding studs as well. Finally, a retaining chain 126 is secured to tubular member 54 as best seen in FIG. 1, and includes a cross piece 128 serving to restrain the bracing legs 108, 110, against undue pivoting away from base 12.

In operation when assembly 10 is in the collapsed condition depicted in FIG. 1, the unit is wheeled to a desired location for play, whereupon winch 102 is rotated so as to take up cable 104. This has the effect of first elevating backboard 72 until the lowermost ends of the element 68, 70 engage cross piece 78. This occurs through pivoting of the linkage arms 90, 92, and as will be understood from a study of FIGS. 2 and 4, the rotational component of such pivoting action is taken up through the links 94, 96; accordingly, the shifting of backboard 72 is essentially vertical along the lengths of the components 80, 82. As takeup of cable 104 progresses further, the shiftable subframe 16 begins to rise vertically with respect to base 12 and the rigid components of frame structure 14. If it is desired to use assembly 10 at the intermediate playing position illustrated in phantom in FIG. 2, the winch 14 is manipulated until the backboard and goal assembly achieves the appropriate height, whereupon the legs 108, 110 are swung to proximity with cross brace 46, and the studs 118, 110 are placed within notches 48. The wing nuts 120, 122 are then tightened, in order to secure the bracing legs in position.

In the event that it is desired to use assembly 10 in the regulation height mode, additional cable is taken up using winch 102 with the effect that the shiftable subframe 16 is moved to its maximum height. At this point, the legs 108, 110 are swung into proximity with cross plate 88, and the studs 118, 120 are positioned in the notches 90, followed by tightening of the wing nuts 122, 124.

When use of assembly 10 is completed, the above procedure is simply reversed, with the effect that the subframe 16, and the attached backboard and goal assembly 18, are returned to the lowered, storage position depicted in FIG. 1. In this position, the overall height of the assembly is less than that of a standard garage door opening, i.e., it is less than 82 inches in height. Accordingly, the collapsed assembly can be wheeled into a garage without difficulty.

It will furthermore be noted that the low storage profile of the assembly hereof is achieved notwithstanding use of a standard backboard 72 with a standard hoop 74. That is to say, the hoop 74 is located on backboard 72 in regulation position adjacent the lowermost edge of the backboard. Nevertheless, by virtue of the unique construction of the overall assembly 10, the extremely low storage profile is obtained.

We claim:

1. In a portable basketball goal assembly including a base, frame means, a backboard, a goal mounted to said backboard, means securing said backboard to said frame means, lifting means operably coupling said frame means to said base for shifting of the frame means and backboard between a lower storage position and an upper playing position, the improvement wherein said securing means comprises structure mounting said backboard on said frame means for up and down shifting movement of the backboard relative to the frame means, said lifting means comprising:

pulley means operatively secured to said frame means; and a cable trained around said pulley means and operatively connected to said backboard, said pulley means and cable means being constructed and arranged for raising and lowering of said frame means relative to said base, and for raising and lowering of said backboard relative to said frame means.

2. The assembly as set forth in claim 1, said pulley and cable means constructed and arranged such that during shifting of the assembly toward said playing position, said pulley and cable operate to first raise said backboard relative to said frame, and then raise said frame relative to said base into a respective playing position.

3. In a portable basketball goal unit provided with a backboard and goal assembly which may be selectively shifted to a regulation playing height, an intermediate position for younger players and a lower position for storage of the unit, the combination of:

a movable base;

an upright frame carried by said base;

a shiftable backboard subframe adjustably mounted on said frame for vertical movement relative thereto;

an upright mounting frame secured to the normally rearmost face of said backboard;

means adjustably connecting the uppermost part of said subframe to said mounting frame for vertical shifting of said backboard relative to said subframe, and manually operable means coupled to said subframe and to said mounting frame for raising and lowering said backboard as said subframe is shifted vertically with respect to said frame and for cooperatively effecting raising and lowering of said backboard with respect to the same subframe in a manner such that after the backboard has been raised a certain distance, the subframe is thereafter raised relative to the frame and visa-versa during lowering of the assembly.

4. The unit as set forth in claim 3, said manually operable means comprising pulley and cable means, said pulley operatively secured to said frame means and said cable trained over said pulley and operatively connected to said backboard.

5. The unit as set forth in of claim 4, said cable being connected to a lever arm which is operably coupled to said backboard and subframe for selectively raising and lowering said backboard relative to said subframe.

6. The unit as set forth in claim 3, including elongated bracing means secured to said backboard and engageable with said base or frame means for stabilizing the backboard.

7. The assembly of claim 6, wherein the upper playing position of said backboard is regulation height, said backboard also being positionable at an intermediate playing position lower than said regulation height.

* * * * *